United States Patent [19]

Gilb

[11] 4,003,179

[45] Jan. 18, 1977

[54] TRUSS HANGER

[75] Inventor: Tyrell T. Gilb, Berkeley, Calif.

[73] Assignee: Simpson Manufacturing Co., Inc., San Leandro, Calif.

[22] Filed: Jan. 21, 1976

[21] Appl. No.: 650,848

[52] U.S. Cl. ..... 52/696; 52/692; 52/693; 52/189; 403/217

[51] Int. Cl.[2] ..... E04C 3/02

[58] Field of Search ..... 52/692, 693, 696, 751, 52/753 C; 403/217

[56] References Cited

UNITED STATES PATENTS

| | | | |
|---|---|---|---|
| 3,314,209 | 4/1967 | Troutner | 52/753 C |
| 3,331,579 | 7/1967 | Petersen | 52/751 X |
| 3,422,591 | 1/1969 | Troutner | 52/693 |
| 3,481,635 | 12/1969 | Tracy | 52/751 |
| 3,596,941 | 8/1971 | Tracy | 52/751 |

*Primary Examiner*—Karl Bell
*Attorney, Agent, or Firm*—James R. Cypher

[57] ABSTRACT

A truss hanger for trusses in which the top chord consists of a pair of parallel wood members and the end web is a metal member such as a tube formed with a flattened end. The hanger is fabricated from flat sheet metal using standard punch-press operations. The ends of the metal webs are connected to the hangers so that the web load is transferred directly to the hanger via metal-to-metal contact.

8 Claims, 14 Drawing Figures

TRUSS HANGER

BACKGROUND OF THE INVENTION

Composite trusses having wood chords and metal webs have been in commercial use for about 16 years. Builders have avoided hanging composite trusses by the top chord members flush with or below the supporting plate member because the custom made hangers were too heavy, too expensive and difficult to install.

Truss fabricators were unable to find a simple solution and resorted to heavily reinforced custom-modified simple joist hangers. Use of redesigned standard joist hangers was, however, not a good solution since the forces acting on a hanger from a simple beam are entirely different from the forces acting on the ends of a truss. Hangers for simple beams merely require a device which transmits supporting load from a bearing member through a strap of "U" element which encapsulates and supports the end of the beam or joist. Usually, the main support is a simple seat area underneath the edge-end of the joist or beam.

The truss, on the other hand presents a different combination of problems and required load bearing functions. The problem is to provide support not only for the end of the upper chord wood members, but also provide support for the end of the terminal metal web which is located at some distance from the end of the upper chord, thus imposing a rotational load in respect to bearing.

Since building walls are seldom constructed to the tolerances required in the fabrication of trusses, a hanger, to be successful commercially must have an adjustability to accommodate the trusses within the tolerance allowable in constructing the building walls.

The current state of the art is to provide a more or less conventional hanger of a size and mass primarily governed by its ability to resist the eccentric arm of loading rather than being governed by the simple load bearing requirements. Into and upon the seat of such a hanger, is normally placed a double-angled clip device designed to pick up the transverse bolt which connects through the chord and provides the end support and connection for the end of the terminal web. Sometimes the lower legs of such a clip are slotted to provide adjustment in respect to the hanger seat. Basically, this clip is the same device as used when the top chord of a truss is installed in simple over-the-top bearing relationship to a support. As previously stated, this combination of required hardware is so excessive in relation to a hangered function for trusses as to practically discourage the use of hangered trusses whenever possible.

SUMMARY OF THE DISCLOSURE

The gist of the present invention is the creation of an entirely new hanger for composite trusses. The truss hanger of the present invention may be fabricated by standard punch-press operations from a strip of sheet metal. The hangers are fabricated without welding, or fasteners and are therefore less expensive to fabricated than existing truss hangers. Because the design follows totally new concepts instead of the "state-of-the-art" present thinking of simple beam hangers, the truss hanger of the present invention uses merely ⅓ the metal for a given required load function as present truss hangers. Results thus far have indicated that the combination of less metal and standard punch-press operations reduces total cost by a factor of 4.

Because of the adjustability feature built into the design, the truss hanger of the present invention can be assembled on the truss at the fabricating plant rather than in the field. The hanger can be assembled to the exact dimensions of the wall spacing and if field adjustment has to be made, workmen in the field merely have to make the final adjustment by simply loosening a bolt and sliding the bolt along the slot in the hanger.

A further feature of the truss hanger of the present invention is that it provides uplift resistance to the truss in respect to the bearing point.

A still further feature is that no secondary or lag screws or bolting is required in the present invention hanger; being entirely a nail-attached device.

BRIEF DESCRIPTION OF THE PREFERRED EMBODIMENTS OF THE INVENTION

Figure 1:
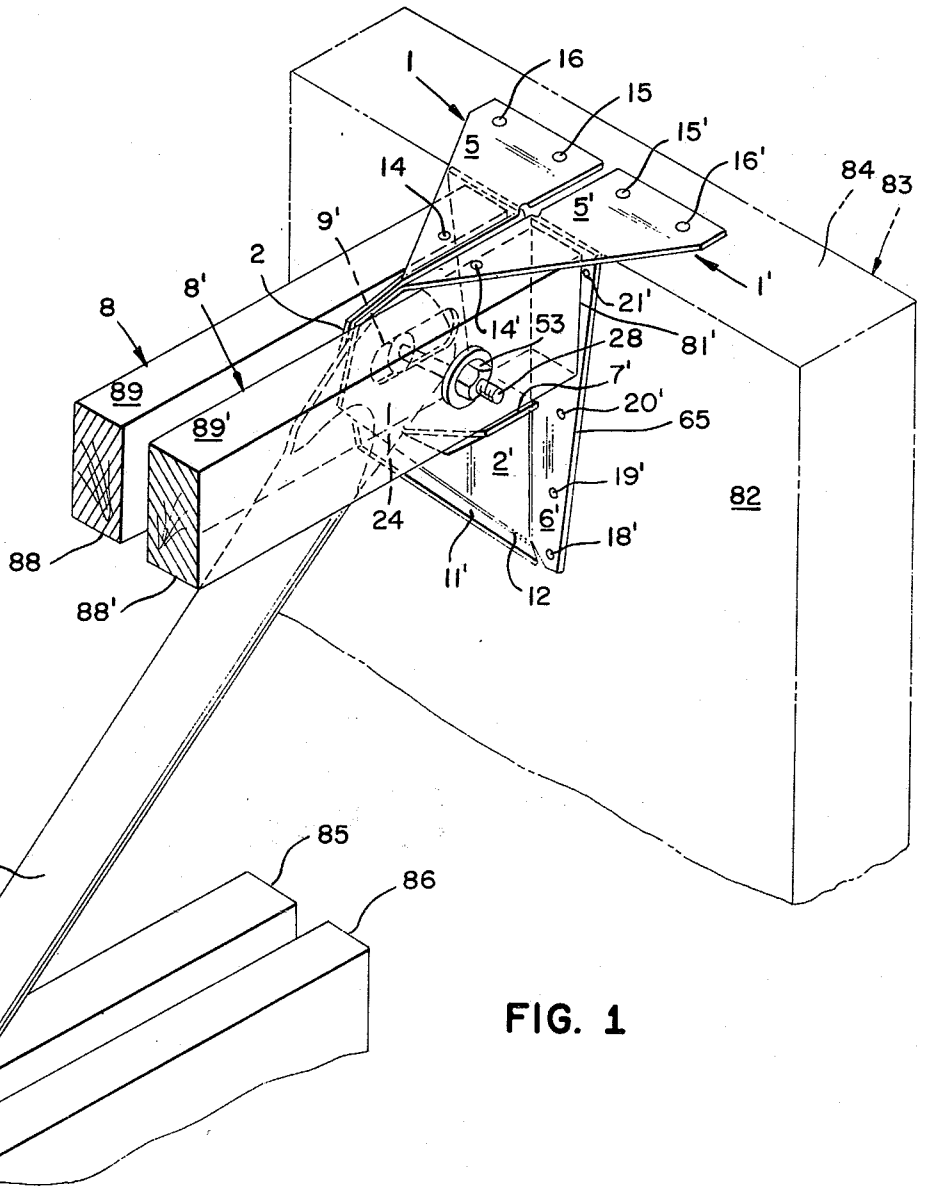
FIG. 1 is a perspective view of the truss hangers of the present invention. The truss hangers are shown supporting the top chords of a truss in which at least the end joints are constructed in accordance with the principles taught in my pending application Ser. No. 507,943 filed Sept. 20, 1974 now U.S. Pat. No. 3,946,532 and entitled Truss Structure With Joint Assembly. Portions of the truss are in cross section and cut away.
Figure 2:
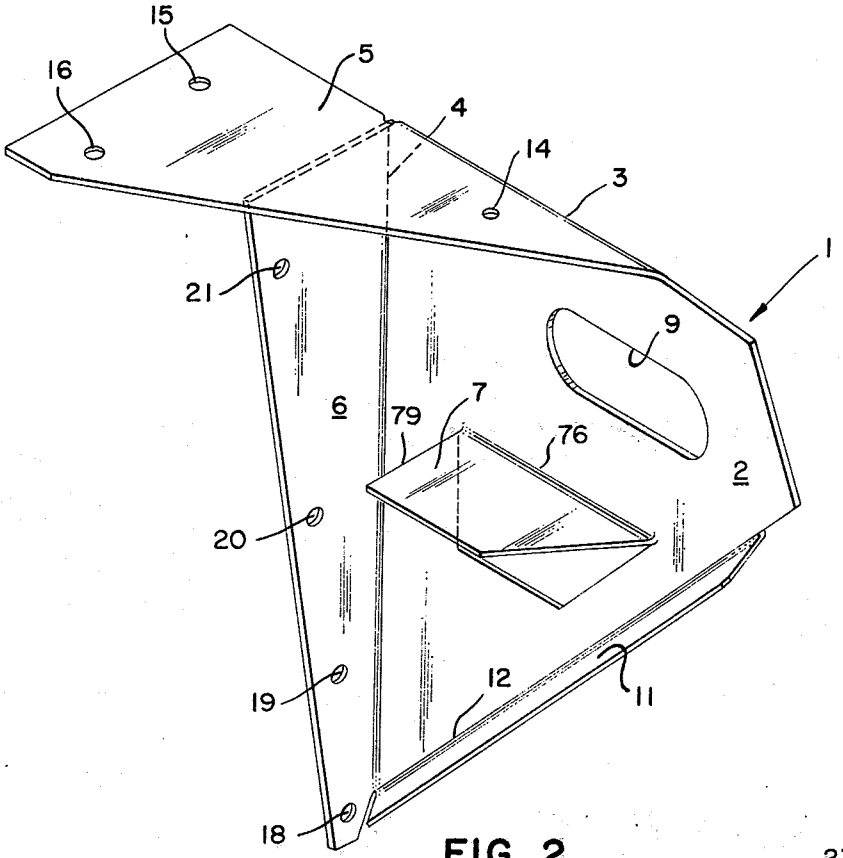
FIG. 2 is an enlarged perspective view of one of the truss hangers shown in FIG. 1.

The truss hanger 1 of the present invention consists briefly of a generally planar side member 2 mounted substantially vertically and having a generally straight and horizontal top edge 3, and a generally vertical back edge 4; a top flange 5 integrally connected to a portion of the top edge and positioned at a generally right angle to the side member, and extending rearwardly beyond the side member; a back flange 6 integrally connected to the back edge of the side member and positioned at a generally right angle to the side member and the top flange; a tab member extending from the side member forming a horizontal base for receiving a member 8 forming the top chord of a truss; and an opening 9 formed in the side member between the tab member and the top flange.

In order to effect an overall weight savings in the design and to enable the hanger to be sheared from a flat strip of metal with the least amount of waste, the planar side member is formed in a generally triangular shape.

The required structural rigidity is imparted to the hanger by providing a front flange 11 integrally connected to the front edge 12 of the side member positioned at a generally right angle to the triangular side member.

Adjustability is attained by forming the opening in the side member as an elongated slot extending in the direction parallel to the tab member.

The top flange is formed with a plurality of nail or other fastener openings 14, 15 and 16. The back flange is formed with nail or other fastener openings 18, 19, 20 and 21.

The truss hanger of the present invention is a part of the end truss joint assembly wherein the upper chord consists of two juxtaposed parallel lumber members 8 and 8' and the end web member 23 consists of a metal member having a flattened end area 24 interposed between the lumber members. The wood members and web are formed with registering openings 26, 26' and 27 respectively. A metal pin 28 dimensioned for receipt within the openings is inserted therethrough. A pair of truss hangers 1 and 1' are placed on either side of the web member at each end bearing joint assembly. The generally planar side members 2 and 2' are mounted substantially vertically on either side of the web member. Each truss hanger has a generally straight and horizontal top edge 3 and 3' and a generally vertical back edge 4 and 4'. Each hanger has a top flange 5 and 5' integrally connected to the top edge and is positioned at generally right angles to the side member with portions extending rearwardly beyond the side members. Back flanges 6 and 6' are integrally connected to the back edges of the side members and are positioned at a generally right angle to the side members and the top flanges. Tab members 7 and 7' extend from the side members forming horizontal bases for receiving each of the lumber members. Openings 9 and 9' formed in the side members between the tab members and the top flanges receive the metal pin 28 therethrough. The mirror image hanger 1' is formed with nail openings 15' and 16' in the top flange and nail openings 18', 19', 20' and 21' in the back flange.

Figures 3, 11, 12, 13, 14:
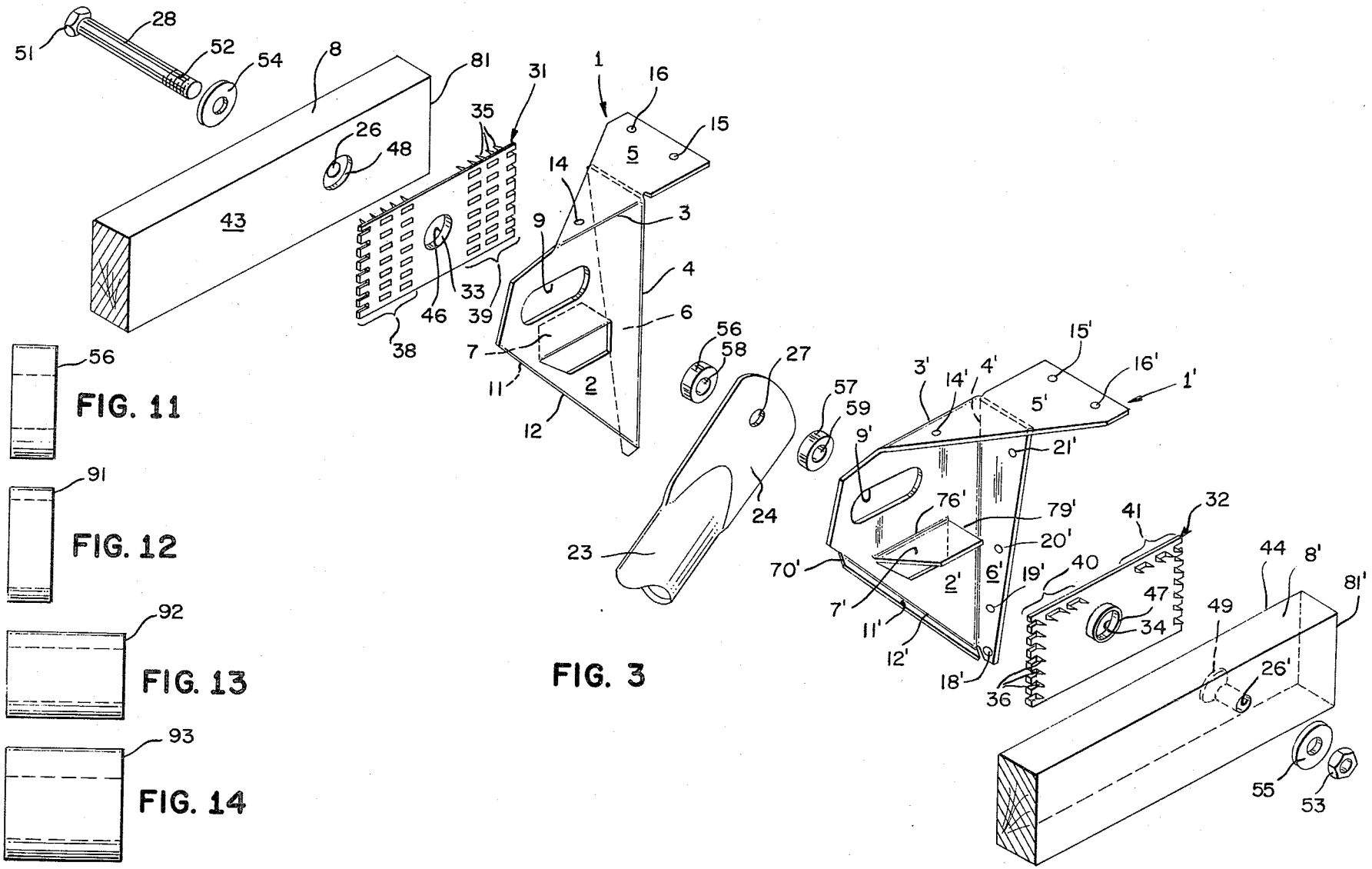
FIG. 3 is an exploded perspective view of the truss hangers and truss joint assembly shown in FIG. 1. Only portions of the chords and web of the truss are shown.
FIG. 11 is a load sleeve with a ½ inch inside diameter and a 1 inch outside diameter.
FIG. 12 is a load sleeve with a ¾ inch inside diameter and a 1 inch outside diameter.
FIG. 13 is a load sleeve with a ½ inch inside diameter and a ¾ inch outside diameter.
FIG. 14 is a load sleeve with a ½ inch inside diameter and a 1 inch outside diameter.
Figure 6:
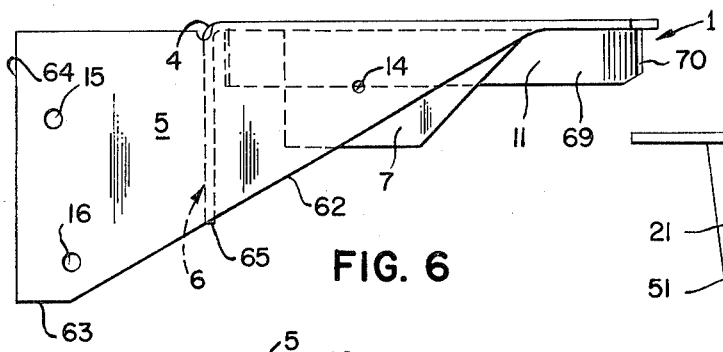
FIG. 6 is a top plan view of the truss hanger shown in FIG. 5.
Figure 4:
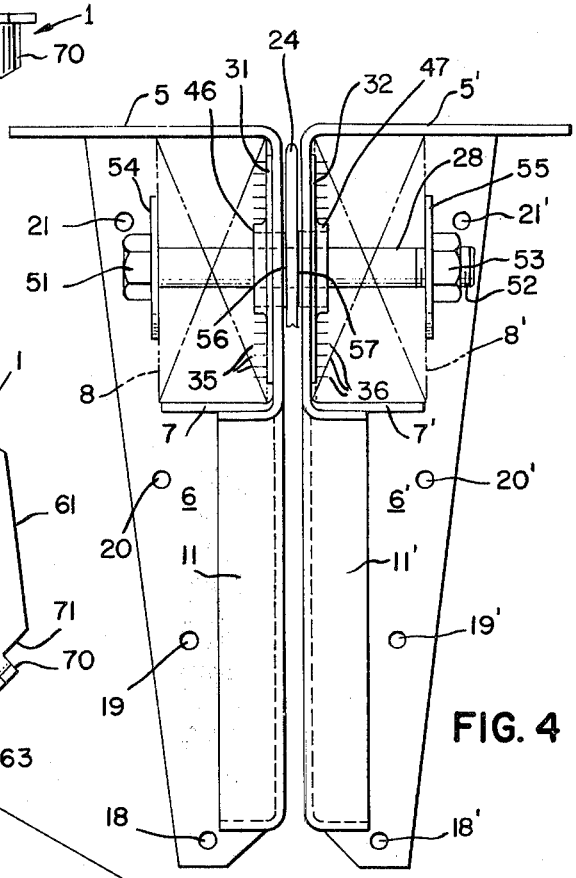
FIG. 4 is front elevation view of the truss hangers and the truss joint assembly. The top chords of the truss are shown in cross section.
Figure 5:
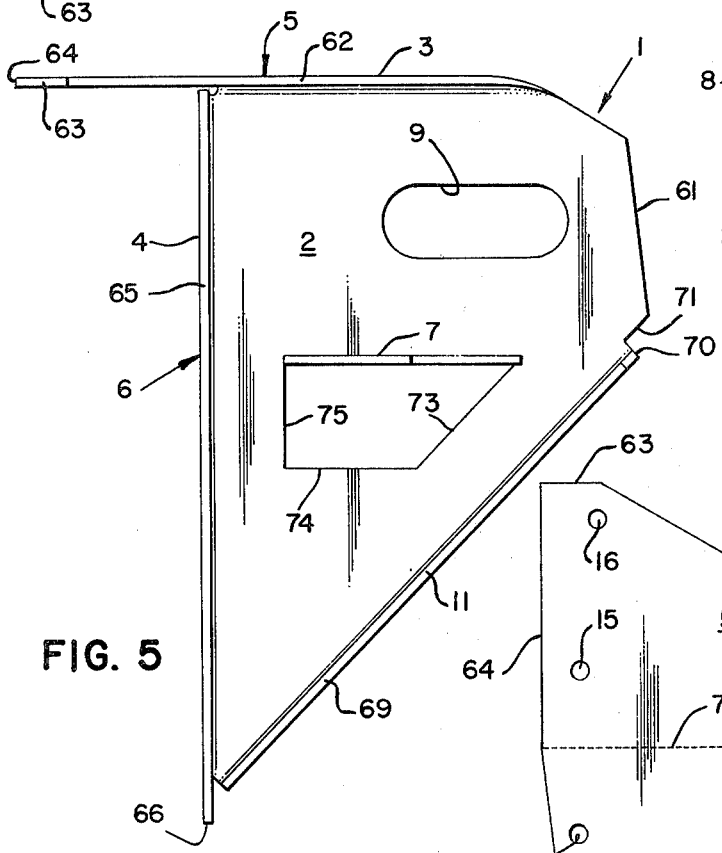
FIG. 5 is a side elevation view of one of the truss hangers.

Referring to FIG. 3, the end bearing joint of a truss constructed in accordance with the principles taught in my patent application Ser. No. 507,943 filed Sept. 20, 1974 entitled Truss Structure With Joint Assembly is shown. The truss joint assembly consists of an upper chord having two juxtaposed parallel lumber members 8 and 8' and an end web member 23 with a flattened end area 24 and an opening 27 therethrough interposed between the two lumber members. A pair of sheet metal fastener plates 31 and 32, each including openings 33 and 34 therethrough and formed with a plurality of sharp pointed fastener prongs 35 and 36 connect the fastener areas 38, 39, 40 and 41 of the plates to the inside faces 43 and 44 of the lumber members. Each of the openings in the plates is surrounded by integrally formed drawn sidewalls extending into the lumber members forming coaxial annular flanges 46 and 47 providing bearing area. Enlarged countersunk openings 48 and 49 in the inside faces of the lumber members are dimensioned to receive the annular flanges of the plates in a force fit. A metal load transfer member having a diameter and a length selected to transfer loads between the metal fastener plates and the metal web members by bearing against a substantial portion of the metal plate flanges in a force fit and against the edges of the openings in the metal web members is provided. This load transfer member may be a short metal pin which does not extend past the drawn flange openings or it may be a pin as shown in FIG. 3 with a head 51 on one end and threads 52 on the other end for receiving a threaded nut 53. Washers 54 and 55 hold the joint assembly together. As shown in FIG. 3, load sleeves 56 and 57 have an inside hole 58 and 59 with a diameter equal to the diameter of the diameter of the pin 28. The outside diameter of the load sleeves are equal to the opening size of openings 9 and 9' and openings 33 and 34 in the fastener plates. Thus load from the web 23 is transferred from the walls of opening 27 to the center portion of load transfer member 28 thence through load sleeves 56 and 57, and then to the sidewalls of the openings 9 and 9' in the truss hangers. Thus web loads are transferred to the hangers through metal to metal contact only. Loads from the wood timber members are transferred to the truss hangers by transmission through the prongs of the prong plate, through the drawn annular flanges, through the load sleeves 56 and 57 and then to the walls of openings 9 and 9' of the truss hangers. Vertical loads from the wood members are transferred to the tab members and the upper flanges. As set forth above, the pin 28 is used only to hold the assembly together and the ends of the pin are not necessary to carry loads. Some load may be carried from the wood through the pin but this is not essential to the operation of the joint. Thus practically all of the load from the trusses is transferred to the hanger through openings 9 and 9' in metal to metal contact. Very little load is transmitted through the bore holes 26 and 26' in the wood and only a small portion of the load is carried by tabs 7 and 7'.

The web trusses for the type of joint assembly shown in FIG. 3 are identical to the truss hangers previously described for other less sophisticated joints which are formed without fastener plates. Truss hangers with triangular or other shapes may be used. Where the truss hanger is triangular in shape the addition of a front flange 11 and 11' gives the necessary structural rigidity.

Figure 7:
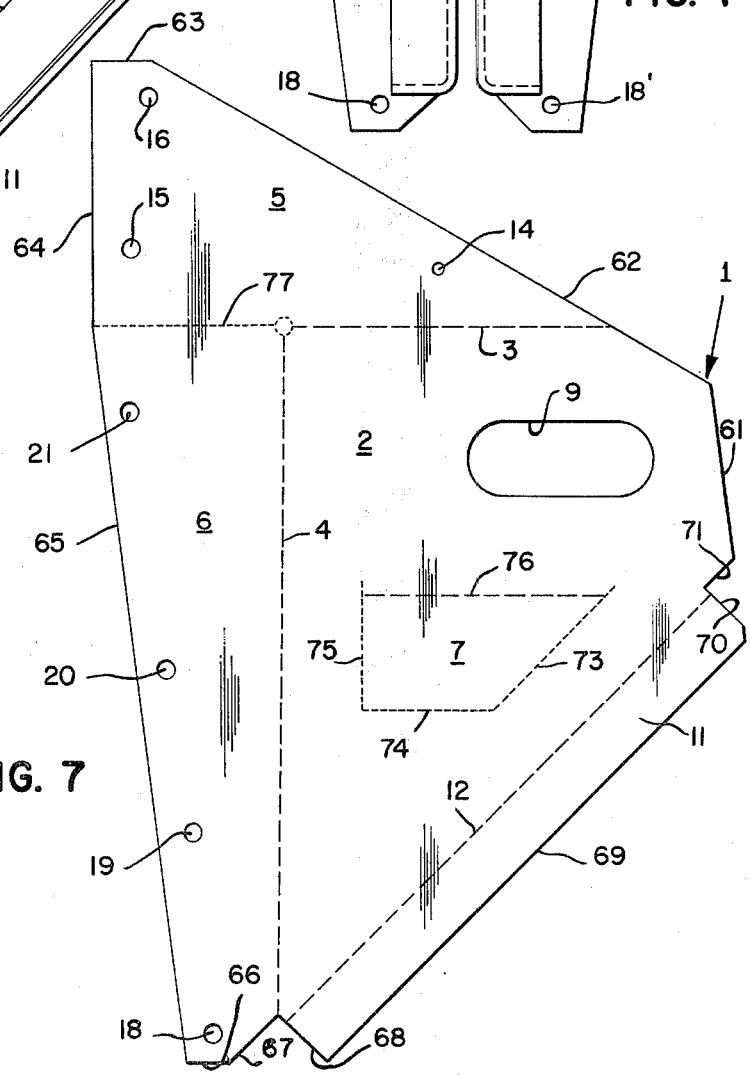
FIG. 7 is a side elevation view of the truss hanger shown in FIG. 5 prior to bending of the sheet metal.

The method of cutting and fabricating the truss hanger is shown in FIG. 7. First a shape as shown in FIG. 7 having edges 61, 62, 63, 64, 65, 66, 67, 68, 69, 70 and 71 is cut out of sheet steel. The opening 9 is then cut out and cuts 73, 74 and 75 are made to form the tab 7. A cut is also made along line 77 to separate the top and back flanges. Nail openings 14–16 are made in the top flange and nail openings 18–21 are made in the back flange. Fabrication is completed by bending top flange along line 3, back flange alone line 4 and front flange 11 along line 12. Tab 7 is bent along line 76.

Figure 10:
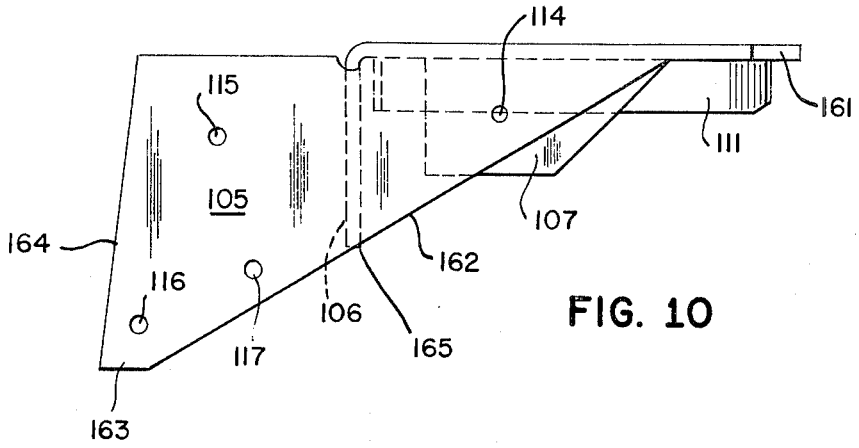
FIG. 10 is a top plan view of the form of the invention shown in FIG. 9.
Figure 9:
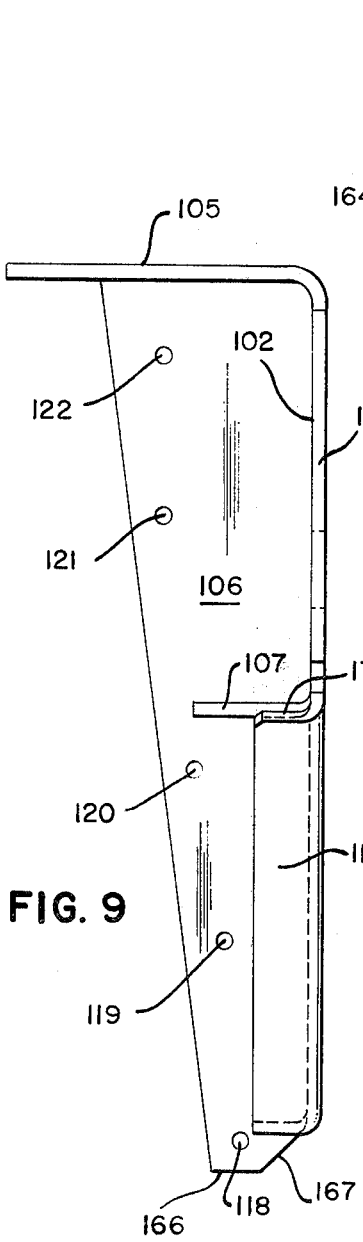
FIG. 9 is a front elevational view of the truss hanger shown in FIG. 8 after the metal has been bent.
Figure 8:
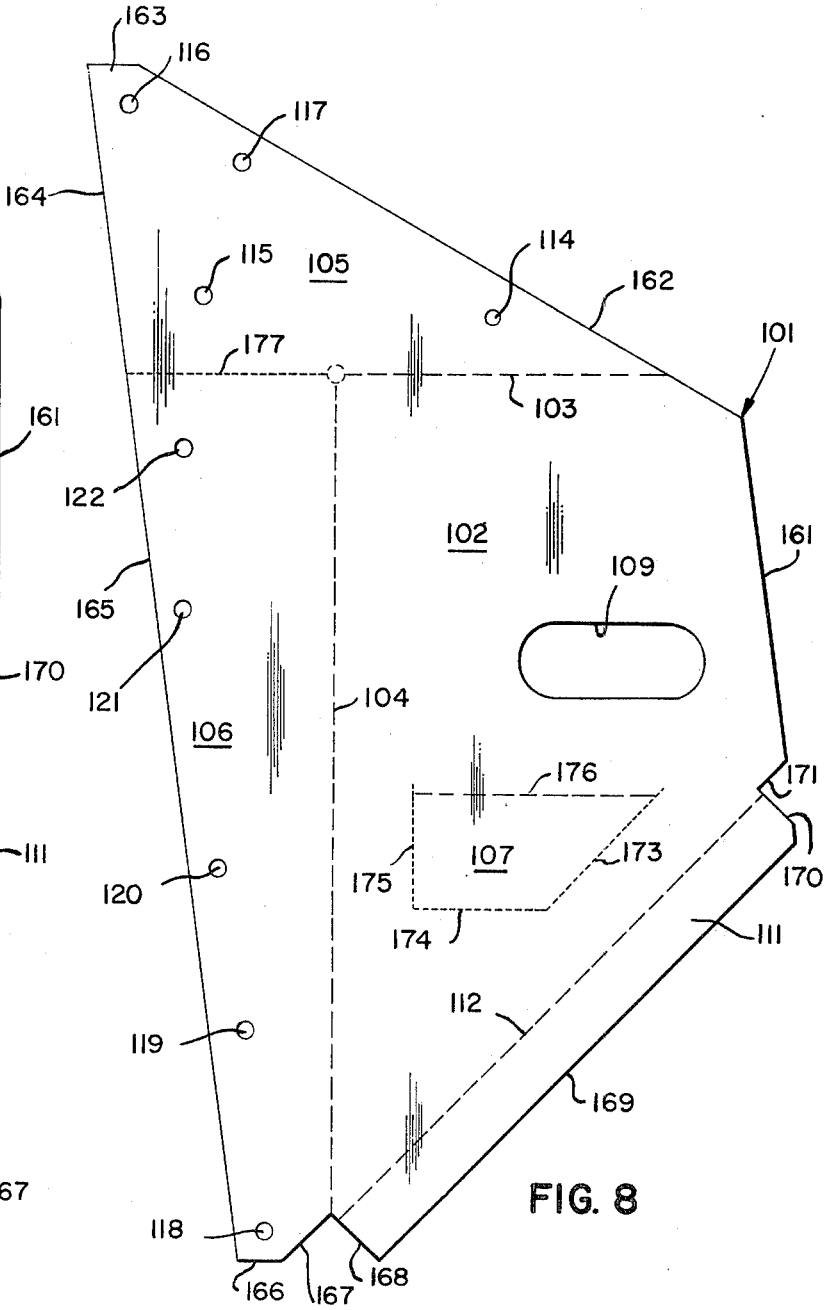
FIG. 8 is a side elevation view of a modified form of the truss hanger shown in FIGS. 1 through 7. This form of the invention is used in supporting trusses capable of supporting heavier loads and/or longer spans. The truss hanger is shown prior to bending of the sheet metal to its final form.

A modified form of the invention is shown in FIGS. 8, 9 and 10. The unique feature of the modified form of the truss hanger is that the same set of dies for making a hanger capable of accommodating trusses with 2 × 4 inches top chords can be used to make hangers for trusses with top chords using 2 × 6 feet. Further, the exact same width strip of metal can be used for both types of hangers.

The hanger 101 consists of a side member 102, having a top edge 103 and a back edge 104. A top flange 105 is connected to the top edge and a back flange 106 is attached to the back edge. Tab member 107 is formed in the side member as well as opening 109. In the preferred form of the invention, a front flange 111 is formed at front edge 112. Nail openings 114, 115, 116 and 117 are punched in the top flange. Nail openings 118, 119, 120, 121 and 122 are punched in the back flange. Edge 161 corresponds to edge 61 of FIG. 7; differing only in length. Edge 106 likewise corresponds to edge 165. The hanger is formed on its other parameters by edges 162, 163, 164, 166 167, 168, 169, 170 and 171. The hanger is fabricated by forming cuts along lines 173, 174 and 175 and bending about line 176 to form tab 107. A cut is made along line 177 and top flange 105 is formed by bending along line 103 and the back flange is formed by bending alone line 106. When a triangular shaped member is formed, a front flange 111 is formed by bending along line 112.

Installation of a typical truss using hangers of the present invention is illustrated in FIG. 1. The wood members of the top chord rest on tabs 7 and 7'. Note that the rear edges 79 and 79' are spaced from the rear flange. The ends 81 and 81' of the wood chord timber members need not be butted against the back flange so that there can be some adjustment of the load sleeves 56 and 57 within slots 9 and 9'.

The back flanges 6 and 6' are nailed to surface 82 of wood structual member 83 and top flanges 5 and 5' are nailed to top surface 84 of the structural member 83.

One of the advantages as previously discussed is the fact that the truss hangers may be attached to the top chord of the truss at the factory and shipped to the building site. The trusses and their hangers are lifted to the top of the building walls and placed thereon. The field workers only need to align the trusses and then nail them to the structural member 84. As stated above, if the wall is out of alignment, the workmen can loosen nut 53 and slide the truss hangers either away or toward the structural member 84 in slots 9 and 9'. After the correct adjustment has been made, the nut 53 is tightened and installation is complete.

For purpose of illustration, FIG. 1 shows a typical bottom chord of a truss with wood members 85 and 86 and another web member 87. The bottom chord need not be wood but may be metal and may consist of either a single wood chord or metal member.

A feature of the present hanger is the fact that the wood top chord members are securely encapsulated by the truss hangers. The bottom edges 88 and 88' of the timber members rest on tabs 7 and 7' and the top faces 89 and 89' are in contact with a substantial portion of the underside of top flanges 5 and 5'. The inside faces 43 and 44 are in contact with the outside surfaces of side faces 2 and 2'. Where required, the ends 81 and 81' of the top chords may be in contact with the back flanges 6 and 6'.

Another feature of the present invention is the fact that the use of the present truss hangers require absolutely no notching or other modification of the top chord wood members nor does it require any modification of the end web member 23. Since the main load is carried by the walls of the slots 9 and 9', the tabs may be minimal in dimension so that they do not interfere with the web member. The triangular shape of the side members carries the web away from the face of structural member 82 while providing the necessary structural support. The long back flange provides the necessary length for providing nail holes.

Another feature of the present invention is the fact that the slots 9 and 9' and 109 and 109' are in the identical position for both 2 inches × 4 inches and 2 inches × 6 inches top chord members. Thus tooling costs are minimized.

In order to carry very heavily loaded trusses, a standard pillow block means may be substituted for the load sleeves 56 and 57. The portion of the pillow block which is round is inserted into the annular flanges 33 and 34 while the square portion is carried by the walls of slots 9 and 9'. Thus the area of contact is a flat surface rather than a tangent edge of the round bearing element.

The configuration of the structure is so constructed that nearly every part has a double function. For example, the back flange not only provides a nailing surface but also rigidizes the entire back portion of the side member 2. In like manner, the top flange provides a nailing surface and also rigidizes the top edge of the side member. Even the tab 7 which provides a seat for the wood member also rigidizes the central portion of the side member. Even the front flange which appears to have no other purpose than to rigidize the front portion of the side member, may be located so that the edges 70 and 70' bear against the underside surfaces 88 and 88' of wood members 8 and 8'.

Web openings 27 may vary in size and ½ inch, ¾ inch, and 1 inch diameter openings are common. In order to accommodate the different size web openings, load sleeves as shown in FIGS. 11 through 14 are provided.

The load sleeve 56 of FIG. 11 has an inside diameter of ½ inch and outside diameter of 1 inch with a width of ⅜ inch.

The load sleeve 91 of FIG. 12 has an inside diameter of ¾ inch, an outside diameter of 1 inch and a width of ⅜ inch.

The load sleeve 92 of FIG. 13 has an inside diameter of ½ inch, an outside diameter of ¾ inch and a width of about 1 inch.

The load sleeve 93 of FIG. 14 has an inside diameter of ½ inch, an outside diameter of 1 inch and a width of 1 inch.

Where the web opening is ½ inch as it would be in the illustration of FIG. 3, two load sleeves of the type shown in FIG. 11 would be used.

Where the web opening is ¾ inch one load sleeve 92 as illustrated in FIG. 13 is inserted into the web opening and two load sleeves 91 as illustrated in FIG. 12 are carried by the load sleeve 92 of FIG. 13. Load sleeves 91 bear against the sides of openings 9 and 9' and annular flanges 33 and 34.

For 1 inch web holes a single load sleeve 93 as illustrated in FIG. 14 is all that is required. The outside 1 inch diameter of the load sleeve bears against the sides of the web opening, the slot openings 9 and 9' and the annular flanges 33 and 34.

The hanger is to be fabricated from either 12 or 14 gauge steel. Preferably holes are dimensioned for Simpson N54A fasteners. These fasteners have a diameter of 0.250 inches and a length of 2½ inches.

For trusses in which the top chords are 2 × 4 feet, as an example, the pin 28 may be ½ inch diameter by 4¼ inches long. Washers may be 12 gauge 1⅞ inches. The prong plates may be 3 inches × 6 inches, 18 gauge, 96 prongs with a 1 inch diameter × 3/16 inch drawn hole.

For truss hangers in which the top chords are two 2 × 6 feet, 7 gauge metal is normally used. Under certain load restrictions, 12 gauge may be used.

By way of example, some approximate dimensions of the truss hanger shown in FIG. 7 are as follows: edge 61—2 7/16 inches, edge 62 — 8 11/16 inches, edge 64—3⅝ inches, edge 65—9⅞ inches and edge 69—7⅞ inches. The hanger is cut from an 8 inches strip blank.

The truss hanger shown in FIG. 8 is also cut from an 8 inches strip blank and some representative approximate dimensions are as follows: edge 161—4⅝ inches, edge 162—9⅜ inches, edge 164—6¼ inches, edge 165—9⅞ inches, and edge 169—7⅞ inches.

I claim:

1. A truss hanger for connecting the end of a truss to an end support, said truss having two vertically spaced chords joined by a plurality of metal web members at joints by pin type connector means, said top chord comprising two parallel juxtaposed structural members, said hanger comprising:

a. a pair of sheet metal members placed in side by side relation each having:

1. a generally planar side member mounted substantially vertically and having a generally straight and horizontal top edge, and a generally vertical back edge;
2. a top flange having a forward portion integrally connected to a substantial portion of said top edge adapted for bearing against the top edges of said top chord structural members and positioned at a generally right angle to said side member for rigidizing said side member along said top edge, and having a rear portion extending rearwardly beyond said side member adapted for bearing upon said end support;
3. a back flange integrally connected to substantially the entire length of said back edge of said side member and positioned at a generally right angle to said side member and said top flange for rigidizing said side member along said back edge and adapted for connection to said end support;
4. a tab member extending from said side member at right angles thereto forming a horizontal base for receiving said structural member forming the top chord of said truss and rigidizing a portion of the mid-portion of said side member; and
5. an opening formed in said side member between said tab member and said top flange adatped for receipt of said pin type connector means.

2. A truss hanger as described in claim 1 comprising:

a. said planar side member has a generally triangular shape.

3. A truss hanger as described in claim 2 comprising:

a. said planar side member has an angularly related front edge; and b. a front flange integrally connected to a substantial portion of said front edge of said side member and positioned at a generally right angle to said triangular side member for rigidizing said front edge of said side member.

4. A truss hanger as described in claim 1 comprising:

a. said opening in said side member is an elongated slot extending in a direction parallel to said tab member.

5. A truss hanger as described in claim 3 comprising:

a. said opening in said side member is an elongated slot extending in a direction parallel to said tab member; and b. said top flange and said back flange are formed with a plurality of openings adapted for receiving nails or other fasteners.

6. In a truss joint assembly wherein the upper chord consists of two juxtaposed parallel lumber members and a plurality of web members interposed between said lumber members; said wood members and said web members are formed with registering openings therethrough, and a metal pin type connnector dimensioned for receipt within said openings, the improvement comprising:

a. a pair of truss hangers, each comprising:

1. a generally planar side member mounted substantially vertically and having a generally straight and horizontal top edge and a generally vertical back edge;
2. a top flange integrally connected to a portion of said top edge and positioned at a generally right angle to said side member, and extending rearwardly beyond said side member;
3. a back flange integrally connected to a substantial portion of said back edge of said side member and positioned at a generally right angle to said side member for rigidizing said side member; and
4. an opening formed in said side member between said tab member and said top flange for receiving said metal pin type connector therethrough.

7. A truss hanger for a composite truss wherein the upper truss chord consists of two juxtaposed parallel lumber members and the end web member has an opening therethrough and is interposed between said lumber member; a pair of sheet metal fastener plates, each including an opening therethrough and formed with a plurality of sharp pointed fastener means connecting said fastener areas of said plates to the inside faces of said lumber members; each of said openings in said plates is surrounded by integrally formed drawn sidewalls extending into said lumber members forming a coaxial annular flange providing bearing area; there being enlarged countersunk openings in the inside faces of said lumber members dimensioned to receive said annular flanges of said plates in a force fit; a metal load transfer member having a diameter and a length dimensioned to transfer loads between said metal fastener plates and said metal web members by bearing against a substantial portion of said metal plate flanges in a force fit, and against the edges of said openings in said metal web members; and means providing lateral support for holding the members of said assembly together the improvement comprising:

a. a pair of truss hangers each having:

1. a generally planar side member mounted substantially vertically and having a generally straight and horizontal top edge, and a generally vertical back edge;
2. a top flange having a forward portion integrally connected to a substantial portion of said top edge adapted for bearing against the top edges of said top chord structural members and positioned at a generally right angle to said side member, for rigidizing said side member along said top edge and having a rear portion extending rearwardly beyond said side members adapted for bearing upon said end support;

3. a back flange integrally connected to substantially the entire length of said back edge of said side member and positioned at a generally right angle to said side member and said top flange for rigidizing said side member along said back edge;

4. a tab member extending from said side member forming a horizontal base for receiving the end of one of said lumber members and rigidizing a portion of the mid-portion of said side member; and 5. an opening formed in said side member between said tab member and said top flange adapted for receiving said metal load transfer member therethrough.

8. A truss hanger as described in claim 7 comprising:

a. said planar side member has a generally triangular shape;

b. said planar side member has an angularly related front edge;

c. a front flange integrally connected to said front edge of said side member and positioned at a generally right angle to said triangular side member;

d. said opening in said side member is an elongated slot extending in a direction parallel to said tab member; and e. said top flange and said back flange are formed with plurality of openings adapted for receiving nails or other fasteners.

* * * * *

UNITED STATES PATENT AND TRADEMARK OFFICE

CERTIFICATE OF CORRECTION

PATENT NO. : 4,003,179
DATED : January 18, 1977
INVENTOR(S) : Tyrell T. Gilb

It is certified that error appears in the above-identified patent and that said Letters Patent are hereby corrected as shown below:

Column 1, line 19, change "of" to ---or---

Column 5, line 4, change "2 x 6 feet" to ---2 x 6's---

Column 7, line 3, change "2 x 4 feet" to ---2 x 4's---

Column 7, line 9, change "6 feet" to ---6's---

Column 7, line 55, change "adatped" to ---adapted---

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*